US009212330B2

(12) United States Patent
Bolton et al.

(10) Patent No.: US 9,212,330 B2
(45) Date of Patent: Dec. 15, 2015

(54) PROCESS FOR REDUCING THE VISCOSITY OF HEAVY RESIDUAL CRUDE OIL DURING REFINING

(71) Applicant: BAKER HUGHES INCORPORATED, Houston, TX (US)

(72) Inventors: Jeffery K. Bolton, Baton Rouge, LA (US); Kimchi Phan, Sugar Land, TX (US); Paul J. Biggerstaff, Stafford, TX (US); Ross Poland, Houston, TX (US)

(73) Assignee: BAKER HUGHES INCORPORATED, Houston, TX (US)

( * ) Notice: Subject to any disclaimer, the term of this patent is extended or adjusted under 35 U.S.C. 154(b) by 101 days.

(21) Appl. No.: 14/067,429

(22) Filed: Oct. 30, 2013

(65) Prior Publication Data

US 2014/0115953 A1 May 1, 2014

Related U.S. Application Data

(60) Provisional application No. 61/720,806, filed on Oct. 31, 2012.

(51) Int. Cl.

| | |
|---|---|
| ***C10L 1/232*** | (2006.01) |
| ***C10L 1/195*** | (2006.01) |
| ***C10G 75/04*** | (2006.01) |

(52) U.S. Cl.

CPC ..... *C10L 1/232* (2013.01); *C10G 75/04* (2013.01); *C10L 1/1955* (2013.01); *C10G 2300/107* (2013.01); *C10G 2300/1077* (2013.01)

(58) Field of Classification Search

CPC ..... C10L 1/232; C10L 1/1955; C10G 75/04; C10G 1/00; C10G 1/107; C10G 2300/1077

See application file for complete search history.

(56) References Cited

U.S. PATENT DOCUMENTS

| | | | | |
|---|---|---|---|---|
| 3,496,097 | A | 2/1970 | Engle | |
| 4,209,422 | A * | 6/1980 | Zimmerman et al. | 516/168 |
| 5,529,930 | A | 6/1996 | Monticello et al. | |
| 5,976,360 | A | 11/1999 | Blum et al. | |
| 8,496,472 | B2 | 7/2013 | Roberts et al. | |
| 2008/0305445 | A1 | 12/2008 | Roberts et al. | |
| 2013/0310492 | A1 * | 11/2013 | Morgan et al. | 524/59 |

FOREIGN PATENT DOCUMENTS

| | | | |
|---|---|---|---|
| CA | 2563585 | A1 | 11/2005 |
| EP | 0048631 | A1 | 3/1982 |
| EP | 0563142 | A1 | 10/1993 |
| WO | 2012121804 | A1 | 9/2012 |

* cited by examiner

*Primary Examiner* — Cephia D Toomer

(74) *Attorney, Agent, or Firm* — Mossman Kumar & Tyler PC

(57) ABSTRACT

Additives may be used to decrease the viscosity of heavy residual hydrocarbons. The additives are prepared using a formulation comprising: a first component selected from the group consisting of (alkoxylated)-(di or tri)-alkyl phenol-aldehyde (amine) resins; α-Olefin-maleic anhydride co-polymers and grafted polymers including half ester/amide and full ester/amide derivatives; and combinations thereof; and a second component which is a synergist and selected from the group consisting of polyamines, amidoamines, imidazolines, and combinations thereof.

26 Claims, No Drawings

PROCESS FOR REDUCING THE VISCOSITY OF HEAVY RESIDUAL CRUDE OIL DURING REFINING

CROSS-REFERENCE TO RELATED APPLICATIONS

This application claims priority from U.S. Provisional Application Ser. No. 61/720,806, filed Oct. 31, 2012, the disclosure of which is fully incorporated herein by reference.

BACKGROUND OF THE APPLICATION

1. Field of the Invention

This invention relates to refining crude oil. This invention particularly relates to improving processing of heavy residual crude oil during refining.

2. Background of the Prior Art

Refining is the process of treating raw hydrocarbon and its conversion into lighter, higher octane number components. The development of the internal combustion engine led to the production of gasoline and diesel fuels. While simple gasoline was sufficient for automobiles, it was the airplane that created a need for high-octane aviation gasoline and then for jet fuels. In addition to fuels, refineries now produce a variety of products such as lubricants but also including many required as initial feed-stocks for the petrochemical industry.

During the course of refining crude oil, the crude oil and resultant process streams may be subjected to distillation, thermal cracking, catalytic conversion, and various other treatments. Cracking is the process whereby complex organic molecules such as kerogens or heavy hydrocarbons are broken down into simpler molecules (e.g. light hydrocarbons) by the breaking of carbon-carbon bonds in the precursors.

During distillation, the higher boiling compounds are separated from compounds often having a higher molecular weight and greater viscosity. After removal of the distillate, the resulting bottoms may be subjected to further cracking until, finally, all that is left is bitumen or coke. Even these compounds have value in today's markets, but most often it would be desirable to produce more rather than less of the comparatively low boiling and more valuable distillates.

Unfortunately, as the viscosity of the heavy distillation bottoms increases, there is a corresponding increase in the difficulty of handling (moving and further refining) such heavy hydrocarbons. In some circumstances, the bottoms can even solidify thereby blocking fluid movement. It would be desirable in the art of refining hydrocarbons to be able to reduce the viscosity of heavy residual crude oil economically and without introducing materials which could complicate further processing.

SUMMARY OF THE INVENTION

In one aspect, the invention is a process for modifying heavy residual hydrocarbons to reduce viscosity comprising admixing the heavy residual hydrocarbons with an additive comprising a first component selected from the group consisting of (alkoxylated)-(di or tri)-alkyl phenol-aldehyde (amine) resins; α-olefin-maleic anhydride co-polymers and grafted polymers including half ester/amide and full ester/amide derivatives; and combinations thereof; and a second component which is a synergist and selected from the group consisting of polyamines, amidoamines, imidazolines, and combinations thereof.

In still another aspect, the invention is a process for modifying heavy residual hydrocarbons to reduce viscosity comprising admixing the heavy residual hydrocarbons with an additive comprising a first component selected from the group consisting of (alkoxylated)-(di or tri)-alkyl phenol-aldehyde (amine) resins; α-olefin-maleic anhydride co-polymers and grafted polymers including half ester/amide and full ester/amide derivatives; and combinations thereof.

DETAILED DESCRIPTION OF THE INVENTION

In one aspect, the invention is a process for modifying heavy residual hydrocarbons comprising admixing the heavy residual hydrocarbons with an additive. The additive is prepared from a formulation including: a first component selected from the group consisting of (alkoxylated)-(di or tri)-alkyl phenol-aldehyde (amine) resins; α-Olefin-maleic anhydride co-polymers and grafted polymers including half ester/amide and full ester/amide derivatives; and combinations thereof. The formulation also includes a second component which is a synergist and selected from the group consisting of polyamines, amidoamines, imidazolines, and combinations thereof.

For the purposes of this application, the term "heavy residual hydrocarbon" means a hydrocarbon having carbon chain length of from about $C_{20}$ to about $C_{70}$. When derived during refining, this material is often referred to as a "resid." Also, for the purposes of this application, the term "heavy residual hydrocarbon" can include hydrocarbons having the same chain length but derived from processes other than normal refining.

As noted in the background of the application, it is often desirable to produce as much lower molecular weight hydrocarbon from crude oil as possible. One problem in doing so is that resid crude oil increases in viscosity as the resid crude oil is subject to more and more extractions of lower molecular weight hydrocarbons. If too much lower molecular weight hydrocarbons are removed from crude oil resid, then it may become too viscous at a point in the process where the process cannot further transport the resulting material for further processing. When this occurs, then expensive and time consuming efforts may have to be employed.

In some embodiments of the method of the application, the additive is prepared from a formulation comprising: a first component selected from the group consisting of (alkoxylated)-(di or tri)-alkyl phenol-aldehyde (amine) resins; α-olefin-maleic anhydride co-polymers and grafted polymers including half ester/amide and full ester/amide derivatives; and combinations thereof; and a second component which is a synergist and selected from the group consisting of polyamines, amidoamines, imidazolines, and combinations thereof. Alkylphenol-formaldehyde resins are typically prepared by the acid or base catalyzed condensation of an alkylphenol with formaldehyde. Alkyl groups are straight or branched and contain about 3 to about 18, preferably about 4 to about 12 carbon atoms. Representative acid catalysts include dodecylbenzenesulfonic acid (DDBSA), toluene sulfonic acid, boron trifluoride, oxalic acid, and the like. Representative base catalysts include potassium hydroxide, sodium methoxide, sodium hydroxide, and the like. In an embodiment, the alkylphenol-formaldehyde resins have a molecular weight (Mn) of about 1,000 to about 50,000. In another embodiment, the alkylphenol-formaldehyde resins have a molecular weight of about 1,000 to about 10,000.

Alkylphenol-formaldehyde resins may be oxyalkylated by contacting the alkylphenol-formaldehyde resins with an epoxide such as ethylene oxide in the presence of a basic catalyst. For example, such resins may be prepared using sodium hydroxide or potassium hydroxide. The molar ratio of epoxide to OH group on the resin may be from about 1 to about 50. In some embodiments, the molar ratio is from about 2 to about 8. In still other embodiments, the molar ratio is from about 3 to about 7. The alkylphenol formaldehyde resins and oxyalkylated alkylphenol formaldehyde resins may be prepared using any method known to be useful to those of ordinary skill in the art of preparing such resins.

The resins, in some embodiments, may be prepared with ethylene oxide and/or propylene oxide. The alkyl groups may have from about 1 to about 30 carbons. Phenols that are useful include, but are not limited to phenol, cresol, and resorcinol. Aldehydes include but are not limited to formaldehyde, acetaldehyde, propylaldehyde, and butyraldehyde and mixtures thereof. Amines, useful for Mannich resins may be selected from the any amine, but in some embodiments they may be selected from the group consisting of ethylene diamine, triethylene tetra-amine, tributyl tetra-amine, tetraethyl penta-amine, pentaethyl hexa-amine, hexaethyl hepta-amine, heptaethyl octa-amine, bis-hexamethytriamine, and mixtures thereof.

When the additive includes an α-olefin-maleic anhydride co-polymer and/or grafted polymer including half ester/amide and full ester/amide derivatives, they may be prepared admixing the monomers and using a catalyst or even heat to polymerize the monomers. Catalysts useful with the method of the application include, but are not limited to free radical initiator, organic peroxides, chromium catalysts, Ziegler-Natta catalysts and metallocene catalysts.

The additives useful with some embodiments of the invention may include other organic compounds and organic solvents. Organic compounds useful with some embodiments of the additives include, but are not limited to amines and esters. For example, a method of the invention may be practiced using additives including triethyl tetra-amine, tributyl tetra-amine, ethylene diamine, tetraethyl penta-amine, ethyl acetate, propyl acetate, ethyl butyrate, and the like and combinations thereof.

The synergists include polyamines, amidoamines, imidazolines, and combinations thereof. When the synergist is a polyamine, in some embodiments is may be selected from polymers of ethylene diamine, triethylene tetra-amine, tributyl tetra-amine, tetraethyl penta-amine, pentaethyl hexa-amine, hexaethyl hepta-amine, heptaethyl octa-amine, bis-hexamethytriamine, and mixtures thereof. The synergists may also be the quaternary ammonium salts of these compounds.

When the synergist is an amidoamines, in some embodiments, it may be a tall oil fatty acid amide prepared using one of ethylene diamine, triethylene tetra-amine, tributyl tetra-amine, tetraethyl penta-amine, pentaethyl hexa-amine, hexaethyl hepta-amine, heptaethyl octa-amine, bis-hexamethytriamine, and mixtures thereof. The synergists may also be the quaternary ammonium salts of these compounds.

When the synergist is an imidazoline, it may be prepared using a tall oil fatty acid-amidoamine and a polyamine as detailed above. It may be further substituted by forming alkyl esters, phosphate esters, thiophosphate esters, Tetra-propenyl succinic anhydride (TPSA), dodecylsuccinic anhydride, amides/esters alkylphosphate esters, arylphosphate esters along the backbone. The synergists may also be the quaternary ammonium salts of these compounds.

In employing the additives of the application, their concentration in heavy resid hydrocarbons may be from about 0.1 to about 10% by weight. In other embodiments, the concentration may be from about 0.1 to about 0.5 weight %.

The organic solvents useful with some embodiments of the invention may include but are not limited to: ethyl benzene, xylene, toluene, and the like. When a solvent is present in the additive, it may be present at a concentration of from about 5 w/v percent to about 95 w/v percent. In other embodiments, the solvent if present at all is present at a concentration of from about 10 to 90 percent. In still other embodiments, the solvent may be present at a concentration of from about 15 to about 85 percent.

The additives of the application are effective at reducing the viscosity of resids. When used at a concentration of 2500 ppm the additives may reduce resid viscosity by from 20 to 70 percent (Viscosity, cP@ 50° C.). In some embodiments, the reduction could be from about 35 to about 60%. In other embodiments, the reduction could be from about 40 to 60%.

In one embodiment, the invention is a process for modifying heavy residual hydrocarbons to reduce viscosity comprising admixing the heavy residual hydrocarbons with an additive comprising a first component selected from the group consisting of (alkoxylated)-(di or tri)-alkyl phenol-aldehyde (amine) resins; α-olefin-maleic anhydride co-polymers and grafted polymers including half ester/amide and full ester/amide derivatives; and combinations thereof. While not as effective as a blend of the resin and a synergist, the resin, by itself can lower resid viscosity.

Some of the components of the additives of the application may have boiling points or vapor pressures that would cause those components to vaporize and be wasted if heated too quickly or under conditions that would not favor incorporation of those components into the heavy resid hydrocarbon. It follows then that when the resid is to be heated to a point near or above the boiling point of the additive component, the resid and additive are to be admixed first and then gradually heated to allow all, or as much as possible, of the additive component to be incorporated into the resid. The additives of the application may be Incorporated into the resids being treated in any way known to be useful to those of ordinary skill in the art The additives of the application advantageously exhibit a synergism. The two components of the additive formulations coming together have a substantially greater impact on improving the physical properties of the modified resid than either component does when acting alone.

Embodiments of the methods of the application may be employed in any application where a resid is being refined, transported, or moved and it would be desirable to avoid having to reheat the resid. In another application, an additive of the invention is employed within a refinery to allow a resid that, unmodified, would be too viscous to move through a unit without the use of a cutter stock or a solvent. In still another embodiment, the additive is used to reduce the amount of energy necessary to pump a resid.

EXAMPLES

The following examples are provided to illustrate the present invention. The examples are not intended to limit the scope of the present invention and they should not be so interpreted. Amounts are in w/v parts or w/v percentages unless otherwise indicated.

Examples 1-3 and Comparative Example A

A sample of a very heavy resid hydrocarbon (BP: 750° F. to about 1300+° F.) is tested for pour point according to ASTM D5950 and viscosity at 50° C. using a scanning Brookfield viscometer. Results are recorded below in Table 1 as Comparative Example A. The same material is then treated with an additive which is a blend of an alkoxylated phenol resin (80%) and imidazoline (20%) at the dosages shown below in Table 1 where the results are also recorded.

TABLE 1

| Example No. | Dosage (ppm) | Pour Point | Viscosity, cP @ 50° C. |
|---|---|---|---|
| Comparative Example A | — | 95° F. | 222,000 |
| Ex. 1 | 5,000 | 65° F. | 19,056 |
| Ex. 2 | 7,500 | 60° F. | 18,796 |
| Ex. 3 | 10,000 | 60° F. | 17,676 |

Examples 4-9 and Comparative Examples B-D

A sample of vacuum towers bottoms from a refining process, a common form of resid (BP750° F. to about 1300° F.), is tested for viscosity improvements using the additive of example 1 and a cutter stock. The cutter stock is a middle distillate hydrocarbon (BP: 350° F. to about 700° F.). The dosages and physical testing results are shown below in Table 2.

TABLE 2

| Sample No. | % Resid | % Cutter Stock | Additive Dosage | Viscosity cP @ 50° C. | Percent Viscosity Reduction |
|---|---|---|---|---|---|
| Comparative Example B | 100 | 0 | — | 15,357 | — |
| Example 4 | 100 | 0 | 1000 | 10,228 | 33% |
| Example 5 | 100 | 0 | 2500 | 6209 | 60% |
| Comparative Example C | 95 | 5 | — | 5004 | 67% |
| Example 6 | 95 | 5 | 1000 | 3099 | 80% |
| Example 7 | 95 | 5 | 2500 | 2360 | 85% |
| Comparative Example D | 80 | 20 | — | 840 | 95% |
| Example 8 | 80 | 20 | 1000 | 595 | 96% |
| Example 9 | 80 | 20 | 2500 | 418 | 97% |

Example 10 and Comparative Example E

A sample of virgin uncracked residue from a first distillation from a refining process (BP: 500° F. to about 1200° F.), is tested for viscosity improvements using the additive of Example 1. The dosages and physical testing results are shown below in Table 3.

TABLE 3

| Sample No. | Additive Dosage | Viscosity cP | Percent Viscosity Reduction |
|---|---|---|---|
| Comparative Example E | — | 956,000 | — |
| Example 10 | 2500 | 215,000 | 78% |

What is claimed is:

1. A process for modifying heavy residual hydrocarbons to reduce viscosity comprising admixing the heavy residual hydrocarbons with an additive comprising:

a first component selected from the group consisting of alkoxylated-(di or tri)-alkyl phenol-aldehyde Mannich resins;

α-olefin-maleic anhydride co-polymers and grafted polymers including half ester/amide and full ester/amide derivatives;

combinations thereof; and a second component which is a synergist and selected from the group consisting of polyamines, amidoamines, imidazolines, and combinations thereof; and wherein the concentration of the additive in heavy resid hydrocarbons may be from about 0.1 to about 10% by weight.

2. The process of claim 1 wherein the alkoxylated-(di or tri)-alkyl phenol-aldehyde Mannich resins are prepared by an acid or base catalyzed condensation of an alkylphenol with an aldehyde.

3. The process of claim 2 wherein alkyl groups of the alkylphenol are straight or branched and contain from about 3 to about 18 carbon atoms.

4. The process of claim 3 wherein the alkyl group have from about 4 to about 12 carbon atoms.

5. The process of claim 2 wherein the alkoxylated alkylphenol-formaldehyde resins have a molecular weight (Mn) of from about 1,000 to about 50,000.

6. The process of claim 5 wherein the alkoxylated alkylphenol-formaldehyde resins have a molecular weight (Mn) of from about 1,000 to about 10,000.

7. The process of claim 2 wherein the alkoxylated-(di or tri)-alkyl phenol-aldehyde Mannich resins are oxyalkylated by contacting the alkylphenol-formaldehyde resins with an epoxide.

8. The process of claim 7 wherein the epoxide is selected from the group consisting of ethylene oxide, propylene oxide and combinations thereof.

9. The process of claim 7 wherein the molar ratio of epoxide to OH group on the resin is from about 1 to about 50.

10. The process of claim 9 wherein the molar ratio of epoxide to OH group on the resin is from about 2 to about 8.

11. The process of claim 10 wherein the molar ratio of epoxide to OH group on the resin is from about 3 to about 7.

12. The process of claim 2 wherein the alkylphenol is prepared using components selected from the group consisting of phenol, cresol, resorcinol, and combinations thereof.

13. The process of claim 2 wherein the aldehyde is selected from the group consisting of formaldehyde, acetaldehyde, propylaldehyde, and butyraldehyde and combinations thereof.

14. The process of claim 1 wherein the additive includes an α-olefin-maleic anhydride co-polymer and/or grafted polymer including half ester/amide and full ester/amide derivatives which is prepared by admixing monomers and using a catalyst or heat to polymerize the monomers.

15. The process of claim 14 wherein the catalysts are selected from the group consisting of free radical initiators, organic peroxides, chromium catalysts, Ziegler-Natta catalysts and metallocene catalysts.

16. The process of claim 1 wherein the synergist is a polyamine selected from the group consisting of polymers of ethylene diamine, triethylene tetra-amine, tributyl tetra-amine, tetraethyl penta-amine, pentaethyl hexa-amine, hexaethyl hepta-amine, heptaethyl octa-amine, bis-hexamethytriamine, and mixtures thereof.

17. The process of claim 16 wherein the synergist is a quaternary ammonium salts of the compounds of claim 16.

18. The process of claim 1 wherein the synergist is an imidazoline prepared using a tall oil fatty acid-amidoamine and a polyamine.

19. The process of claim 18 wherein the imidazoline is further substituted by forming at least one functional group along the backbone of the imidazoline; wherein the at least one functional group is selected from the group consisting of alkyl esters, phosphate esters, thiophosphate esters, Tetra-propenyl succinic anhydride (TPSA), dodecylsuccinic anhydride, amides/esters alkylphosphate esters, arylphosphate esters.

20. The process of claim 18 wherein the synergists is a quaternary ammonium salts of an imidazoline prepared using a tall oil fatty acid-amidoamine and a polyamine.

21. The process of claim 19 wherein the synergist is a quaternary ammonium salt of the further substituted imidazoline.

22. The process of claim 1 wherein the concentration may be from about 0.1 to about 0.5 weight %.

23. The process of claim 1 wherein the additives are effective at reducing the viscosity of resids; when used at a concentration of 2500 ppm; reduces resid viscosity by from 20 to 70 percent (Viscosity, cP@ 50° C.).

24. The process of claim 23 wherein the reduction in viscosity is from about 35 to about 60%.

25. The process of claim 24 wherein the reduction in viscosity is from about 40 to 60%.

26. A process for modifying heavy residual hydrocarbons to reduce viscosity comprising admixing the heavy residual hydrocarbons with an additive comprising a component selected from the group consisting of alkoxylated-(di or tri)-alkyl phenol-aldehyde Mannich resins; α-olefin-maleic anhydride co-polymers and grafted polymers including half ester/amide and full ester/amide derivatives; and combinations thereof; and wherein the concentration of the additive in heavy resid hydrocarbons may be from about 0.1 to about 10% by weight.

* * * * *